United States Patent [19]

Conciauro et al.

[11] 4,389,594

[45] Jun. 21, 1983

[54] DEVICE FOR ELECTRONICALLY TUNING A POWER MAGNETRON

[75] Inventors: Giuseppe Conciauro; Paolo Arcioni, both of Pavia, Italy

[73] Assignee: Societa Italiana Telecomunicazioni Siemens S.p.A., Milan, Italy

[21] Appl. No.: 175,923

[22] Filed: Aug. 6, 1980

[30] Foreign Application Priority Data

Aug. 7, 1979 [IT] Italy ..... 24966 A/79

[51] Int. Cl.[3] ..... H01J 25/50

[52] U.S. Cl. ..... 315/39.55; 331/5; 331/88; 315/39.59; 333/21 R; 333/24

[58] Field of Search ..... 315/39.55, 39.57, 39.59, 315/39.77; 331/5, 88; 333/21 R, 21 A, 24

[56] References Cited

U.S. PATENT DOCUMENTS

| | | | |
|---|---|---|---|
| 3,139,592 | 6/1964 | Sisson | 331/5 |
| 3,178,652 | 4/1965 | Scharfman et al. | 331/5 |
| 3,333,148 | 7/1967 | Buck | 315/39.55 |
| 3,334,267 | 8/1967 | Plumridge | 315/39.55 |
| 3,365,609 | 1/1968 | Barbasso, Jr. | 315/39.55 |
| 3,636,403 | 1/1972 | Edwards et al. | 315/39.55 |
| 3,882,352 | 5/1975 | Osepchuk et al. | 315/39.55 |
| 4,162,459 | 7/1979 | Scharfman | 331/88 |
| 4,219,758 | 8/1980 | Karp | 315/3.6 |

*Primary Examiner*—Saxfield Chatmon, Jr.
*Attorney, Agent, or Firm*—Karl F. Ross

[57] ABSTRACT

The anode cavity of a power magnetron is connected through a coupling slot to a reactively terminated waveguide structure containing one or more selectively magnetizable ferrite elements acting as adjustable differential phase shifters for two microwave components circulating in opposite directions through the structure or traversing a guide portion in the same direction but with opposite circular polarization. In the first instance the structure comprises two parallel rectangular-section waveguides with a common lateral wall having a proximal and a remote opening serving as directional couplers therebetween; in the second instance the structure is a circular-section waveguide with a main portion occupied by the ferrite element and transition portions separating that main portion from the coupling aperture and from the reactive termination.

8 Claims, 6 Drawing Figures

FIG.1
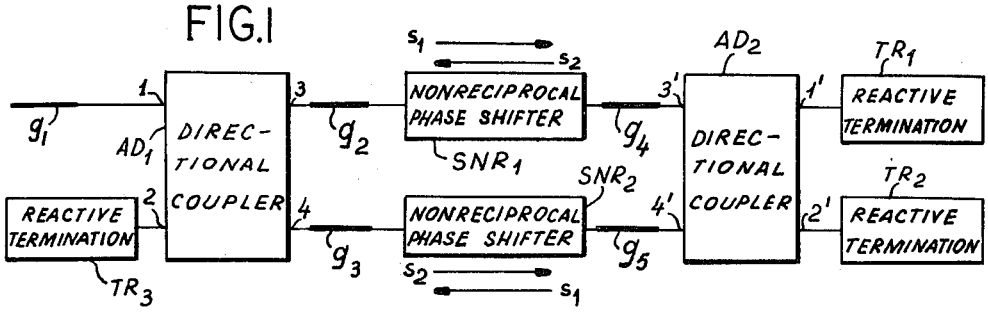
FIG.2A
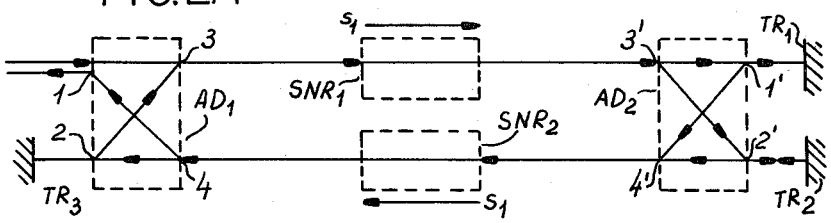
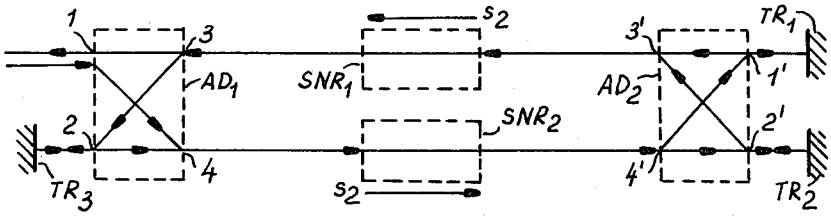
FIG. 2B
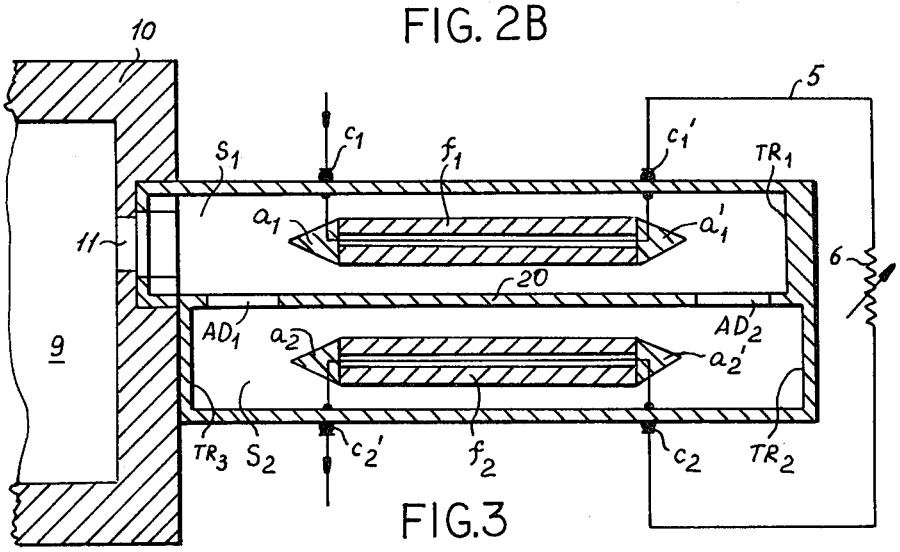
FIG.3

DEVICE FOR ELECTRONICALLY TUNING A POWER MAGNETRON

FIELD OF THE INVENTION

Our present invention relates to a device for the electronic tuning of a power magnetron with the aid of one or more current-controlled elements inserted in an extension of the anode cavity of the magnetron.

BACKGROUND OF THE INVENTION

Conventional devices of the type here envisaged comprise an ancillary resonant cavity connected via a coupling aperture or iris with the anode cavity and provided with a partly magnetized ferrite insert whose magnetization may be increased or diminished by the application of a variable control current thereto. The ancillary resonant cavity may be designed as a dual-mode phase shifter in the shape of a waveguide of square or circular cross-section short-circuited at one end, the current-controlled ferrite insert being preceded by a similar insert of constant magnetization serving to transform a linearly polarized incoming microwave in a nonreciprocable manner into a circularly polarized wave whose phase velocity is modified by the other insert. With such a tuning device, giving rise to a standing wave of circular polarization whose wavelength depends on the degree of magnetization of the second ferrite insert and thus on the intensity of the control current, the operating frequency of the magnetron may be modified within a range of roughly 1%.

Within that range of adjustment, however, the operating efficiency of the tuning device decreases significantly from the midfrequency toward the limits of the range whereby pulses generated in the output of the magnetron have amplitudes which vary undesirably with the tuning frequency. Moreover, such a known tuning device cannot be used with high-power magnetrons since the waveguide serving as an extension of the anode cavity must be limited in its transverse dimensions in order to avoid the excitation of higher modes. Thus, the ferrite inserts present in that waveguide are subjected to relatively strong magnetic microwave fields which cannot be increased at will if the generation of unstable spin waves is to be avoided.

OBJECTS OF THE INVENTION

An important object of our present invention, therefore, is to provide an improved tuning device for power magnetrons whose peak output power is substantially constant throughout the tuning range.

Another object is to provide a device of this nature adapted to operate with very high power.

SUMMARY OF THE INVENTION

A tuning device according to our invention comprises a waveguide structure connected at one end via a coupling aperture with the anode cavity of an associated magnetron and provided at another end with reactive termination means, nonreciprocable transmission means including at least one ferrite insert in that structure for differentially shifting the phases of two microwave components each originating at the coupling aperture and returning thereto after reflection at the reactive termination means, and circuit means for subjecting the ferrite insert to a variable magnetization current.

The two microwave components referred to above could travel over different paths, without change in polarization, or may travel over the same path with counterrotating circular polarization. In the first instance the transmission means may include two directional couplers at locations close to and remote from the coupling aperture leading to the anode cavity, these couplers splitting the incoming microwave into a pair of components circulating in opposite directions through a portion of the waveguide structure containing the ferrite insert. In the second instance the waveguide structure may comprise a guide of identical configuration in two mutually orthogonal axial planes, as will be the case with a square or a circular cross-section, with the coupling aperture designed as a slot extending in one of these planes for giving passage to a microwave that is linearly polarized in the other plane and is subject to degeneration into the two counterrotating components referred to.

BRIEF DESCRIPTION OF THE DRAWING

The above and other features of our invention will now be described in detail with reference to the accompanying drawing in which:

FIG. 1 is a block diagram of a tuning device representing a first embodiment of our invention;

FIGS. 2A and 2B are diagrams similar to that of FIG. 1, showing the circulation of two different microwave components through a common waveguide structure included in that embodiment;

FIG. 3 is a longitudinal sectional view of such a waveguide structure together with part of an associated magnetron;

SPECIFIC DESCRIPTION

Figure 4:
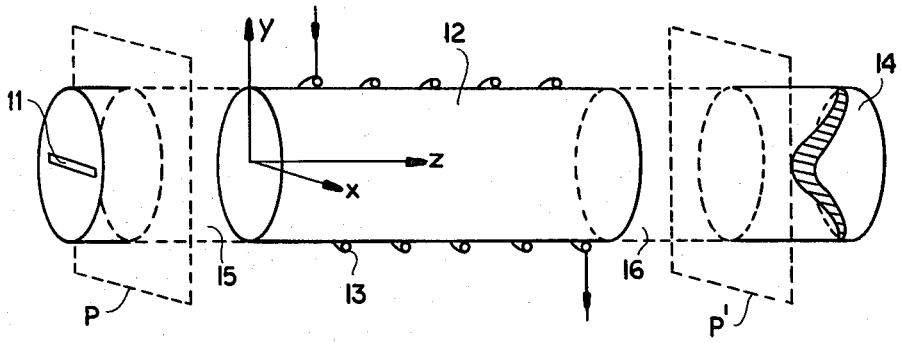
FIG. 4 is a perspective diagrammatic view of another waveguide structure representing a second embodiment of our invention.

In FIG. 1 we have shown portions $g_1$–$g_5$ of a waveguide structure illustrated only diagrammatically. Guide portion $g_1$, extending from a coupling aperture 11 (FIG. 3) of an associated magnetron not illustrated in FIG. 1, terminates at a port 1 of a 3-dB directional coupler $AD_1$ having another port 2 connected to a reactive termination $TR_3$. Two further ports 3 and 4 of coupler $AD_1$ are linked via guide portions $g_2$ and $g_3$ with respective nonreciprocal and substantially identical phase shifters $SNR_1$ and $SNR_2$ respectively separated by guide portions $g_4$ and $g_5$ from ports 3' and 4' of a similar coupler $AD_2$. Ports 1' and 2' of the last-mentioned coupler are connected to reactive terminations $TR_1$ and $TR_2$, respectively.

A wave passing from port 3 to port 3' by way of guide portions $g_2$ and $g_4$ undergoes a certain phase shift $s_1$ in circuit $SNR_1$ while a wave traversing that circuit in the opposite direction experiences a different phase shift $s_2$. Similarly, a wave passing through circuit $SNR_2$ from port 4' to port 4 via guide portions $g_5$ and $g_3$ experiences the aforementioned phase shift $s_1$ while a wave passing through circuit $SNR_2$ in the opposite direction from port 4 to port 4' undergoes a phase shift $s_2$. Phase shifts $s_1$ and $s_2$ may be jointly varied by the passage of a control current through or around the two phase-shifting circuits, e.g. as described hereinafter with reference to FIG. 3.

Each coupler $AD_1$, $AD_2$ splits an incoming microwave into two approximately equal components whose paths have been separately illustrated, for the sake of clarity, in FIGS. 2A and 2B. FIG. 2A shows the path of a wave entering port 1 of coupler $AD_1$ and continuing via port 3 thereof and phase shifter $SNR_1$ to port 3' of coupler $AD_2$. There a part of this wave component goes on to port 1', is reflected at termination $TR_1$ to the same port and exits from the coupler at its port 4'; another part passes within the coupler from port 3' to port 2', is reflected to the latter port by termination $TR_2$ and rejoins the first part exiting at port 4'. The wave then traverses phase shifter $SNR_2$ and enters coupler $AD_1$ at its port 4 where part of it returns to port 1 for retransmission to the magnetron cavity through its coupling aperture while the remainder exits through port 2 and, after reflection to the same port by termination $TR_3$, reverts to port 3 so as to retrace the path previously described. The wave component completing the loop back to the magnetron cavity thus undergoes a phase shift equal to $2s_1+k$ where k is a constant determined by the circuit parameters.

As indicated in FIG. 2B, another component of the incoming wave passes within coupler $AD_1$ from port 1 to port 4, then traverses the phase shifter $SNR_2$ and enters the coupler $AD_2$ at port 4'. There, again, part of that wave travels straight on through port 2' to which it returns after reflection at termination $TR_2$ for transmission to port 3' where it rejoins another part of that wave which had gone through port 1' and been reflected thereto by termination $TR_1$. The wave then traverses phase shifter $SNR_1$ to reach port 3 whence part of it is returned to the magnetron cavity via port 1 while another part is directed to port 2 and reflected thereto at termination $TR_3$ whence it continues by way of port 4 over the path already traced. The wave component completing the loop of FIG. 2B experiences a phase shift $2s_2+k$. The resulting phase difference of absolute value $2(s_1-s_2)$ depends upon the control current transmitted to circuits $SNR_1$ and $SNR_2$; the device of FIG. 1, therefore, is the equivalent of a variable reactive load coupled to the anode cavity of the magnetron so as to determine its operating frequency.

Reference will now be made to FIG. 3 which shows a physical waveguide structure operating in the manner discussed above. The structure comprises two guides $S_1$ and $S_2$ of rectangular cross-section with coplanar major surfaces and with minor sides adjoining along a common lateral wall 20 having two openings which constitute the couplers $AD_1$ and $AD_2$ of FIGS. 1, 2A and 2B. Guide $S_1$ communicates with the anode cavity 9 of a magnetron 10, illustrated only in part, through the aforementioned coupling aperture 11 which may be a rectangular slot paralleling the major sides of that guide. Phase shifters $SNR_1$ and $SNR_2$ of the preceding Figures are represented by intermediate portions of guides $S_1$ and $S_2$ occupied by respective hollow ferrite inserts $f_1$ and $f_2$ of substantially identical structure which are transversely magnetized by a control current traversing a wire 5 which passes insulatedly through a pair of connectors $c_1$, $c_1'$ on guide $S_1$ and $c_2$, $c_2'$ on guide $S_2$. The intensity of the current and thus the degree of magnetization can be adjusted, for both inserts simultaneously, with the aid of means schematically represented by a variable resistance 6. The ferrite inserts $f_1$ and $f_2$ are provided with impedance-matching extremities $a_1$, $a_1'$ and $a_2$, $a_2'$ of tapered configuration as is well known per se. Reference in this connection may be made to Radar Handbook by Merrill I. Skolnik, McGraw-Hill Book Company, 1970 edition, chapter 12 (see, for example, FIG. 27).

The reactive terminations $TR_1$, $TR_2$ and $TR_3$ of FIGS. 1, 2A and 2B are represented in FIG. 3 by a conductive end wall of guide $S_1$ opposite aperture 11 and by two similar end walls of guide $S_2$. It will be noted that the inner surfaces of end walls $TR_1$ and $TR_2$ are relatively offset, with wall $TR_1$ approaching closer than wall $TR_2$ to coupler opening $AD_2$. We have found that this offsetting minimizes the variations in circuit efficiency with tuning frequency.

From a comparison of FIG. 3 with FIGS. 2A and 2B it will be apparent that one wave component circulates clockwise through waveguide structure $S_1$, $S_2$, entering the guide $S_2$ via opening $AD_2$ after traversing the phase shifter comprising ferrite insert $f_1$, while the other wave component circulates counterclockwise through this structure, entering guide $S_2$ via opening $AD_1$ and returning to guide $S_1$ via opening $AD_2$ before traversing that phase shifter in the opposite direction. The other phase shifter comprising insert $f_2$ is also traversed in opposite directions by these two components.

In FIG. 4 we have diagrammatically illustrated a waveguide structure comprising a circularly cylindrical guide portion 12 communicating at opposite ends, via similar guide portions 15 and 16, with coupling aperture 11 and with an end wall 14 constituting a reactive termination. Waveguide structure 12, 15, 16 is centered on an axis z of a Cartesian coordinate system whose axis x parallels the coupling slot 11; the structure is otherwise of identical configuration in the two mutually orthogonal planes xz and yz except that end wall 14 is shown to bulge toward the slot 11 in plane xz.

Figure 5:
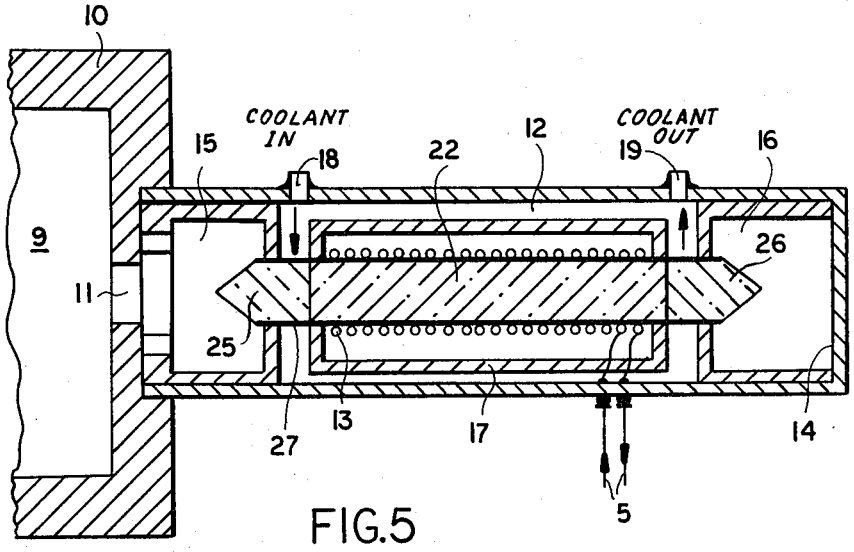
FIG. 5 is a sectional view similar to FIG. 3 but relating to the embodiment of FIG. 4.

A microwave coming from the anode cavity of the associated magnetron (not shown in FIG. 4) passes the slot 11 with linear polarization parallel to axis y, the wave thus oscillating in a $TE_{11}$ mode. Between two imaginary transverse planes P intersecting guide portions 15 and 16, this microwave may be considered divided into two counterrotating circularly polarized components. A ferrite insert occupying guide portion 12 in whole or in part, not shown in FIG. 4 but illustrated at 22 in FIG. 5, is longitudinally magnetized to a selected degree with the aid of a control current traversing a coil 13 which in FIG. 4 is wound externally on the guide and in FIG. 5 envelops only the ferrite insert 22. The two counterrotating components thus excited undergo different phase shifts, both depending on the magnitude of the control current, in guide portion 12. Guide portions 15 and 16 form two symmetrical transition zones in which no phase shift takes place. With the reactive termination of end wall 14 differing in the two mutually orthogonal planes as described above and illustrated in FIG. 4, the $TE_{11}$ mode will again dominate in the last part of guide portion 16 located between that end wall and a plane P' parallel to plane P.

The component rotating counterclockwise as viewed in direction z undergoes a larger phase shift than the clockwise-rotating component on traveling toward wall 14. A similar situation exists on the return travel after reflection at that end wall so that the two phase shifts will again be cumulative for each mode and will affect the tuning of the magnetron essentially as described above.

FIG. 5 shows the ferrite insert 22 as provided with impedance-matching extremities 25 and 26 respectively located in transition zones 15 and 16. The magnetized part of the insert, surrounded by coil 13, is conductively connected by a layer 27 with the metallic housing of magnetron 10. A yoke 17 embraces the coil 13 to provide a latching effect as described in Radar Handbook, supra, pages 12–29, 12–30.

The nonuniform termination 14 shown in FIG. 4 has an effect similar to that described with reference to walls $TR_1$ and $TR_2$ in FIG. 3, i.e. a minimization of the frequency dependence of the circuit efficiency. With uniform termination, as indicated in FIG. 5, one of the two counterrotating components may have a wavelength which with a certain degree of partial magnetization is equal to a whole number of half-wavelengths of the other component; under these conditions, the loading of the anode cavity by the reactance of the waveguide structure may be substantially eliminated at the midpoint of the range of adjustment. A supplemental reactance of capacitive or inductive character will then be introduced by a change in the magnitude of the control current.

We claim:

1. A device for electronically tuning a power magnetron provided with an anode cavity, comprising:

a first waveguide connected at one end to said anode cavity through a coupling aperture and provided with a first reactive termination at the opposite end;

a second waveguide communicating via a first directional coupler with a section of said first waveguide adjacent said one end thereof and via a second directional coupler with a section of said second waveguide adjacent said opposite end thereof, said second waveguide being provided with a second reactive termination adjacent said second directional coupler and with a third reactive termination adjacent said first directional coupler;

a first ferrite insert disposed in said first waveguide between said first and second directional couplers;

a second ferrite insert disposed in said second waveguide between said first and second directional couplers; and control means for subjecting each of said ferrite inserts to a variable magnetization current, thereby differentially shifting the phases of two microwave components traversing said waveguides through said directional couplers in mutually opposite directions.

2. A device as defined in claim 1 wherein said waveguides are parallel structures of rectangular cross-section separated by a common lateral wall, said directional couplers being openings in said lateral wall.

3. A device as defined in claim 2 wherein said reactive terminations are end walls perpendicular to said lateral wall.

4. A device as defined in claim 3 wherein the end walls constituting said first and second reactive terminations are offset from each other in the direction of wave propagation.

5. A device as defined in claim 1, 2, 3 or 4 wherein said control means comprises a common energizing circuit for said ferrite inserts.

6. A device for electronically tuning a power magnetron provided with an anode cavity, comprising:

an elongate waveguide of identical configuration in two mutually orthogonal axial planes, said waveguide being connected at one end to said anode cavity through a coupling slot extending in one of said planes and being provided with a reactive termination at the opposite end, said waveguide being longitudinally divided into a first transition portion adjoining said one end, a main portion adjoining said first transition portion and a second transition portion extending from said main portion to said opposite end;

a ferrite insert disposed in said main portion; and control means for subjecting said ferrite insert to a variable magnetization current for differentially shifting the phases of two counterrotating components of a linearly polarized microwave transmitted to said waveguide from said anode cavity through said coupling slot and reflected back toward said coupling slot by said reactive termination, said first and second transition portions being devoid of phase-shifting means.

7. A device as defined in claim 6 wherein said reactive termination is a transverse end wall bulging toward said one end in the plane of said coupling slot.

8. A device as defined in claim 6 or 7 wherein said ferrite insert has impedance-matching extensions substantially unaffected by said magnetization current projecting into said first and second transition portions.

* * * * *